US005959404A

United States Patent [19]

Nortrup et al.

[11] Patent Number: 5,959,404

[45] Date of Patent: Sep. 28, 1999

[54] STARTING AID FOR METAL HALIDE LAMPS

[75] Inventors: Edward H. Nortrup, Stoneham; James C. Morris, Wakefield, both of Mass.

[73] Assignee: Osram Sylvania Inc., Danvers, Mass.

[21] Appl. No.: 08/372,069

[22] Filed: Jan. 12, 1995

[51] Int. Cl.[6] ..... H01J 17/30; H01J 17/34

[52] U.S. Cl. ..... 313/634; 313/631; 313/594; 315/344

[58] Field of Search ..... 313/634, 631, 313/594, 607; 315/344, 267

[56] References Cited

U.S. PATENT DOCUMENTS 5,323,091 6/1994 Morris ..... 315/344

OTHER PUBLICATIONS

Patrick H. Garrett, *Analog Systems For Microprocessors and Minicomputers*, Reston Publishing Co., Inc. "Reliability of Electronic Systems" Chap. 10 pp. 221–233, 1978 (no month).

*Primary Examiner*—Michael Day
*Attorney, Agent, or Firm*—William H. McNeill

[57] ABSTRACT

An arc tube comprises a light transmissive body containing an arc generating and sustaining medium and has a press seal formed at one end of said body. The press seal comprises a planar portion separating opposed edges. A first foil is sealed in the planar portion. A lead-in conductor is attached to the foil and extends outside of the body and an electrode is also attached to the foil and extends inside the body. A first cavity is formed on a first of the edges and a second cavity is formed on a second of the edges. A fill is provided in each of the cavities for supporting emission of ultraviolet radiation; and a second foil sealed in the planar portion is attached to the first foil, said second foil having a first end terminating in the first cavity and a second end terminating in the second cavity. A ground plane is provided adjacent the cavities. A high voltage pulse applied to the electrodes, and, thus, the foils, creates a capacitive discharge creating the ultraviolet radiation which aids in starting the lamp in which the arc tube is employed.

5 Claims, 2 Drawing Sheets

STARTING AID FOR METAL HALIDE LAMPS

TECHNICAL FIELD

This invention relates to high pressure discharge lamps and more particularly to a starting aid therefor. Still more particularly, the invention relates to a redundant ultraviolet starting aid incorporated into the arc tube of the discharge lamp.

BACKGROUND ART

U.S. Pat. No. 5,323,091 teaches an ultraviolet starting aid incorporated into the press seal area of an arc tube. This patent is commonly owned with the instant application, (GTE Products Corporation having changed its name to Osram Sylvania Inc.), and is incorporated herein by reference. As shown in the above-referenced patent, the starting aid comprises a cavity containing a gaseous fill which is formed on the planar surface of the press seal and, in some embodiments, in contact, directly or indirectly, with the molybdenum (moly) foil of the seal and in other embodiments having a separate lead-in or a second foil attached to the seal foil. It has been found that when the cavity is in contact with the moly foil the integrity of the seal is jeopardized, often causing failure of the lamp in which it is employed. Failure of the seal is also high when separate electrodes are used. When a second foil is employed leading to a cavity it is often found that the sealing operation fractures the second foil and destroying the electrical connection to the cavity.

DISCLOSURE OF THE INVENTION

It is, therefore, an object of the invention to obviate the disadvantages of the prior art.

It is another object of the invention to enhance arc tube starting.

Yet another object of the invention is the provision of a redundant starting aid system.

These objects are accomplished, in one aspect of the invention by an arc tube comprising: a light transmissive body containing an arc generating and sustaining medium; a press seal formed at one end of said body, said press seal comprising a planar portion separating opposed edges; a first foil sealed in said planar portion; a lead-in conductor attached to said foil and extending outside of said body and an electrode attached to said foil and extending inside said body; a first cavity formed on a first of said edges and a second cavity formed on a second of said edges; a fill in each of said cavities for supporting emission of ultraviolet radiation; and a second foil sealed in said planar portion and being attached to said first foil, said second foil having a first end terminating in said first cavity and a second end terminating in said second cavity.

Putting the cavities on the edges of the press seal area as opposed to the planar area thereof does not jeopardize the integrity of the seal and the redundancy greatly increases the chance that at least one cavity and its associated foil will remain operational after the seal is formed. In a second embodiment of the invention cavities are formed at both ends of the arc tube, further increasing the redundancy.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
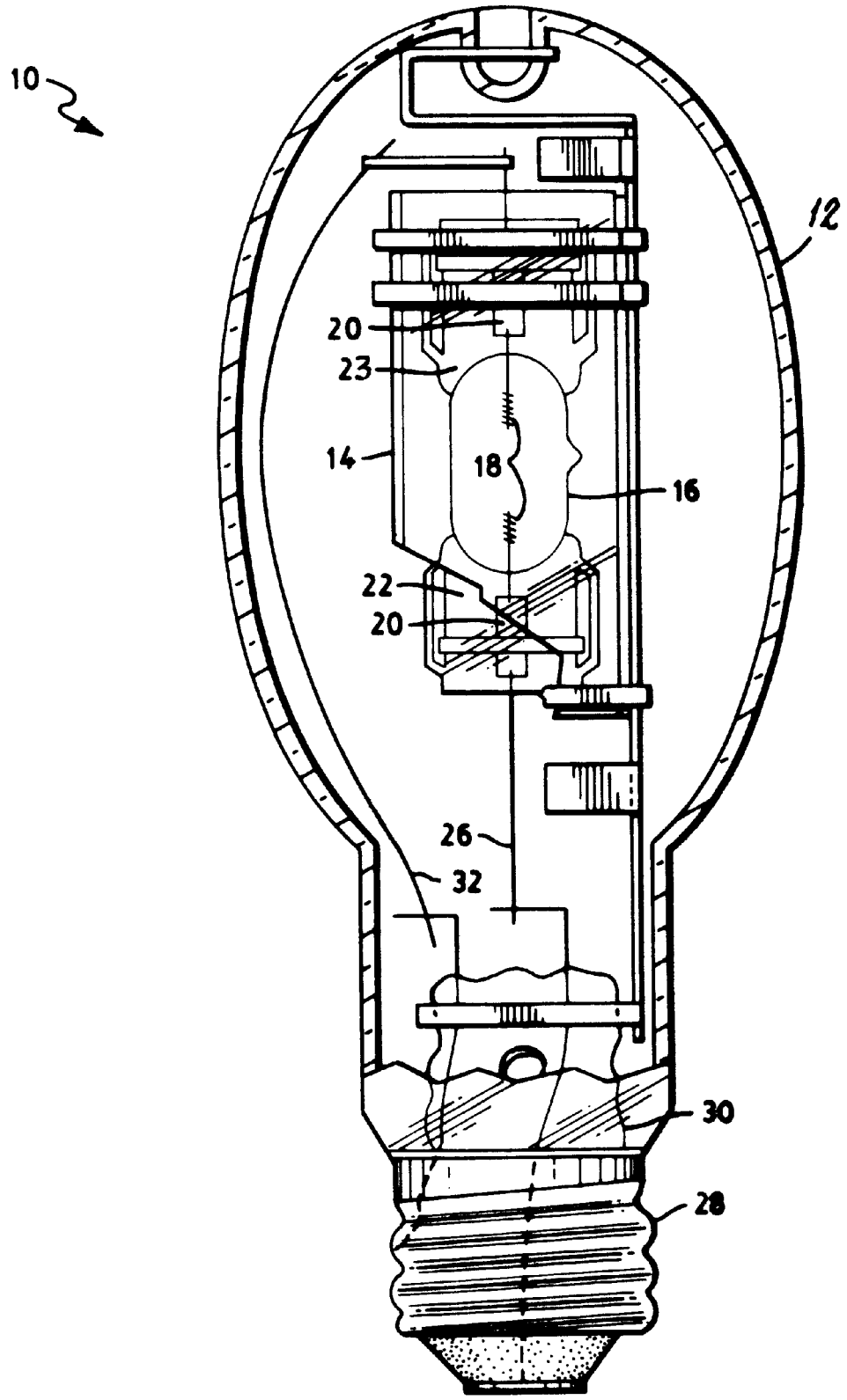
FIG. 1 is an elevational view, partially in section, of a lamp employing the invention.
Figure 2:
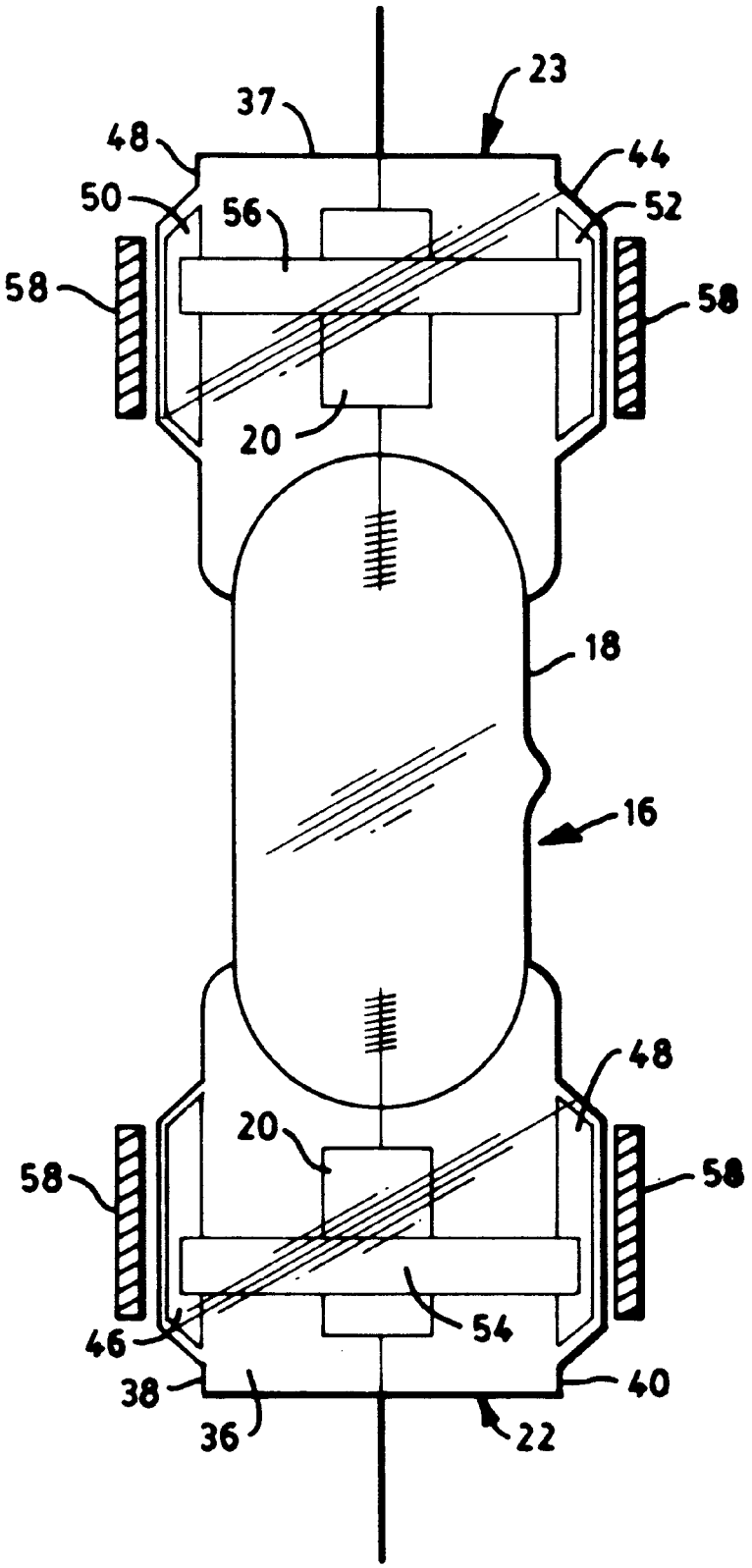
FIG. 2 is an elevational view of an arc tube of the invention.

Referring now to the drawings with greater particularity there is shown in FIG. 1 a metal halide arc discharge lamp 10 having a sealed envelope 12 enclosing a sleeve 14 of quartz or other suitable materail, such as an aluminosilicate glass. The sleeve 14 surrounds an arc tube 16 having electrodes 18 located at opposite ends thereof and a fill material capable of generating and sustaining an arc. The fill can comprise mercury, metal halides and argon, as is well known. Each electrode is coupled to a moly ribbon 20 which is enclosed in a press seal 22, 23, that hermetically seals the arc tube. Electrical energy is coupled from a lamp base 28 through a lamp stem 30 and leads 32 and 26 to the electrodes 18 of the arc tube.

The arc tube 16 comprises a light transmissive body of quartz or other suitable material. The press seals 22, 23, comprise planar portions 36, 37 separating opposed edges 38, 40 and 42, 44, respectively. A first cavity 46 is formed in edge 38 and a second cavity 48 is formed in edge 40. A third cavity 50 is formed on edge 42 and a fourth cavity 52 is formed on edge 44. A fill, such as argon or nitrogen, is provided in the cavities and can be obtained from the flush gases, or provided via a dispenser, as taught in the above-identified U.S. Pat. No. 5,323,091. As noted therein, the dispenser is a composition that includes a material to be dispensed, such as mercury, which enhances ultraviolet radiation.

Electrodes in the form of moly foil ribbons 54 and 56, respectively, are attached to the foils 20 and extend into the cavities. The foils 54 and 56 are attached at the outermost ends of the foils 20 and need not be hermetically sealed where they are attached to foils 20. The supply voltage, which can be in the order of 2.5 kv or more, can then be brought to the cavity without interrupting the main seal. To create the capacitive discharge a ground plane 58 is required. In normal tube construction this ground plane can be provided by the standard mount supporting structure, such as is known in the art. A number of suitable mounting structures are shown in U.S. Pat. No. 5,252,885, the teachings of which are hereby incorporated by reference.

The redundancy of this starting aid system greatly enhances the operation of the lamp. The second cavity at each end of the lamp increase the probability that at least one cavity will remain operational after the sealing operation. The inclusion of starting aid cavities at both ends of the arc provides the instant start characteristics. Only one of the cavities will operate; and that will be the cavity at the high voltage end of the arc tube.

As noted above, during starting the ballast circuit will supply high voltage pulses on the order of 2.5 kv to 4.0 kv, to the lead-in wire connected to the center contact of the lamp base. This voltage is transferred to the moly foil and the functional cavity. Because the outside of the cavity is in contact with the ground plane 58 (which can be a shroud clip as shown in U.S. Pat. No. 5,252,885) which is at a low floating potential, a capactive discharge is created which generates the ultraviolet radiation for starting the lamp.

While there have been shown an described what are at present considered the preferred embodiments of the invention, it will be apparent to those skilled in the art that various changes and modifications can be made herein without departing from the scope of the invention as defined by the appended claims.

What is claimed is:

1. An arc tube comprising: a light transmissive body containing an arc generating and sustaining medium; a press seal formed at one end of said body, said press seal comprising a planar portion separating opposed edges; a first foil sealed in said planar portion; a lead-in conductor attached to said foil and extending outside of said body and an electrode attached to said foil and extending inside said body; a first cavity formed on a first of said edges and a second cavity formed on a second of said edges; a fill in each of said cavities for supporting emission of ultra-violet radiation; and a second foil sealed in said planar portion and being attached to said first foil, said second foil having a first end terminating in said first cavity and a second end terminating in said second cavity.

2. The arc tube of claim 1 wherein said body has a second end with a second press seal formed thereon, said second end being oppositely disposed from said one end; said second press seal comprising a second planar portion separating opposed second edges; a third foil sealed in said second planar portion; a second lead-in conductor attached to said second foil and extending outside of said body and a second electrode attached to said second foil and extending inside said body; a third cavity formed on a first of said second edges and a fourth cavity formed on a second of said second edges; a fill in each of said third and fourth cavities for supporting emission of ultra-violet radiation; and a fourth foil sealed in said second planar portion and being attached to said third foil, said fourth foil having a first end terminating in said third cavity and a second end terminating in said fourth cavity.

3. The arc tube of claim 2 wherein said first, second, third and fourth cavities contain a second medium which supports emission of ultra violet radiation upon reception of electrical energy.

4. The arc tube of claim 1 wherein said first and second cavities contain a second medium which supports emission of ultra violet radiation upon the reception of electrical energy.

5. An arc discharge lamp comprising: an envelope of light transmissive material; an arc discharge tube comprising a light transmissive body containing an arc generating and sustaining medium; a press seal formed at one end of said body, said press seal comprising a planar portion separating opposed edges; a first foil sealed in said planar portion; a lead-in conductor attached to said foil and extending outside of said body and an electrode attached to said foil and extending inside said body; a first cavity formed on a first of said edges and a second cavity formed on a second of said edges; a fill in each of said cavities for supporting emission of ultra-violet radiation; and a second foil sealed in said planar portion and being attached to said first foil, said second foil having a first end terminating in said first cavity and a second end terminating in said second cavity, mounted in said envelope; and means for coupling electrical energy to said arc tube and at least one of said cavities whereby ultra violet radiation is emitted for assisting in initiation of an arc discharge within said arc tube.

* * * * *